US008348229B2

(12) United States Patent
Burns

(10) Patent No.: US 8,348,229 B2
(45) Date of Patent: Jan. 8, 2013

(54) FAUCET ASSEMBLY

(75) Inventor: Martin P. Burns, Forked River, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 414 days.

(21) Appl. No.: 12/592,304

(22) Filed: Nov. 23, 2009

(65) Prior Publication Data

US 2011/0120581 A1 May 26, 2011

(51) Int. Cl.
*F16K 31/02* (2006.01)

(52) U.S. Cl. ..... 251/129.04; 251/129.06; 4/623

(58) Field of Classification Search ..... 251/129.04; 4/623

See application file for complete search history.

(56) References Cited

U.S. PATENT DOCUMENTS

| | | | | |
|---|---|---|---|---|
| 4,980,933 | A * | 1/1991 | Tsutsui et al. | 4/420.2 |
| 6,082,407 | A * | 7/2000 | Paterson et al. | 137/801 |
| RE37,888 | E * | 10/2002 | Cretu-Petra | 236/12.12 |
| 6,513,787 | B1 * | 2/2003 | Jeromson et al. | 251/129.04 |
| 6,854,658 | B1 * | 2/2005 | Houghton et al. | 236/12.12 |
| 7,174,577 | B2 * | 2/2007 | Jost et al. | 4/623 |
| 8,006,712 | B2 * | 8/2011 | Boey | 137/15.17 |
| 8,127,782 | B2 * | 3/2012 | Jonte et al. | 137/1 |
| 2006/0214016 | A1 * | 9/2006 | Erdely et al. | 236/12.12 |
| 2007/0157978 | A1 * | 7/2007 | Jonte et al. | 137/613 |
| 2008/0271238 | A1 * | 11/2008 | Reeder et al. | 4/597 |

* cited by examiner

*Primary Examiner* — John K Fristoe, Jr.
*Assistant Examiner* — Matthew W Jellett
(74) *Attorney, Agent, or Firm* — Francis C. Hand; Carella, Byrne, et al.

(57) ABSTRACT

The faucet assembly employs a sensor on the side of the spigot to control the flow of water from the spigot. An initial waving of a user's hand across the sensor causes the spigot to be opened and a subsequent waving of the user's hand across the sensor causes the spigot to be closed.

12 Claims, 2 Drawing Sheets

FAUCET ASSEMBLY

This invention relates to a faucet assembly. More particularly, this invention relates to an automatic hands-free faucet assembly.

As is known, various types of faucets have been provided for hands-free operation whereby continuous contact of a user with the faucet is required. Generally, these faucets employ a proximity detector to detect the presence or absence of a user's hands below the faucet and to activate a water flow in response to detection of the user's hands and to shut off the water flow in the absence of the user's hands. Examples of such hands-free faucets are found in U.S. Pat. Nos. 6,691,340; 7,104,519; 7,150,293 and 7,174,577. Generally, the user must maintain interaction with a sensor and stay within the detection zone to obtain water flow. With these touch free methods, the user must find the sensor zone and maintain interaction within that zone to keep water flow. This method of detection and faucet operation can be a source of user frustration.

In some instances, a user wishing to obtain a small amount of water from a hands-free faucet, for example, for combing one's hair or to wet a small section of a paper towel, has had difficulty in obtaining the small amount of water desired. In this respect, waving a comb under the faucet may not produce any water flow since the sensors used to detect the presence of a user's hands do not react to the presence of a comb or like items. Also, waving a user's hand in front of such a faucet generally does not result in a flow of water since the sensors do not react during the limited time the hand is placed under the faucet. Holding of the user's hand in front of the faucet until water begins to flow and then quickly removing one's hand usually produces an amount of water that is in excess of the amount desired.

Accordingly, it is an object of the invention to provide a faucet assembly that can be operated in a hands-free manner in an efficient manner.

It is another object of the invention to provide a hands-free faucet assembly that does not require the presence of a user's hands in the water flow path of the assembly for operation.

It is another object of the invention to be able to control the output of a hands-free faucet assembly in an efficient manner.

It is another object of the invention to be able to control the shutting off of a hands-free faucet assembly in an efficient manner.

Briefly, the invention is directed to a faucet assembly comprised of a spigot for dispensing a flow of water through a predetermined path; a supply pipe for delivering water to the spigot; and a solenoid valve in the pipe for movement between a closed position in the pipe to block a flow of water through the pipe to the faucet and an open position to allow passage of a flow of water to the faucet.

In accordance with the invention, a sensor is provided in spaced relation to the path of water flow for sensing movement of an object, such as the waving of a user's hand, along with a control box that is responsive to the sensor for opening and closing of the solenoid valve.

The sensor is preferably mounted on the side of spigot out of the path of water flow and emits a control signal to the control box in response to a sensed movement, for example, of a waved hand, thereby.

The control box is mounted on the supply pipe and houses an electrical circuit that is operable to emit a first signal to the valve in response to a first control signal from the sensor indicative of a sensed movement of a hand by the sensor in order to move the valve to the open position. The control box is also operative to emit a second signal to the valve in response to a second control signal from the sensor indicative of a further sensed movement of a hand by the sensor within a predetermined time period in order to move the valve to the closed position.

In use, when a user first waves a hand, or other item, within the range of the sensor, a control signal is emitted to the electrical circuit in the control box and a responsive signal is emitted to the solenoid valve to open. The valve then stays open while water is supplied to and out of the spigot. When the user is no longer desirous of having water from the spigot, the user waves a hand, or other item, in the range of the sensor causing a second control signal to be emitted to the electrical circuit in the control box. The control box then emits a responsive signal to the solenoid valve to close, thereby shutting off the flow of water in the supply pipe.

Should a user not activate the sensor a second time, after a predetermined time period an adjustable timing switch with a preset time delay in the electrical circuit actuates the control box to emit a signal to the solenoid valve to close the valve and the flow of water. In addition, the timing can be set to coincide with duration requirements for hand washing protocols.

Should a user wish to have a limited amount of water, the user need only wave a hand, or other item, by the sensor a first time to open the solenoid valve and a second time after a brief period of time, such as one second, to close the solenoid valve.

Repeated waving of a hand would cause the solenoid valve to pulse and the flow of water to be pulsed from the spigot.

Advantageously, the user has full control of the faucet water flow and duration and is not required to maintain close proximity in the sensing field of the sensor.

These and other objects and advantages of the invention will become more apparent taken in conjunction with the accompanying drawings wherein.

Figure 1:
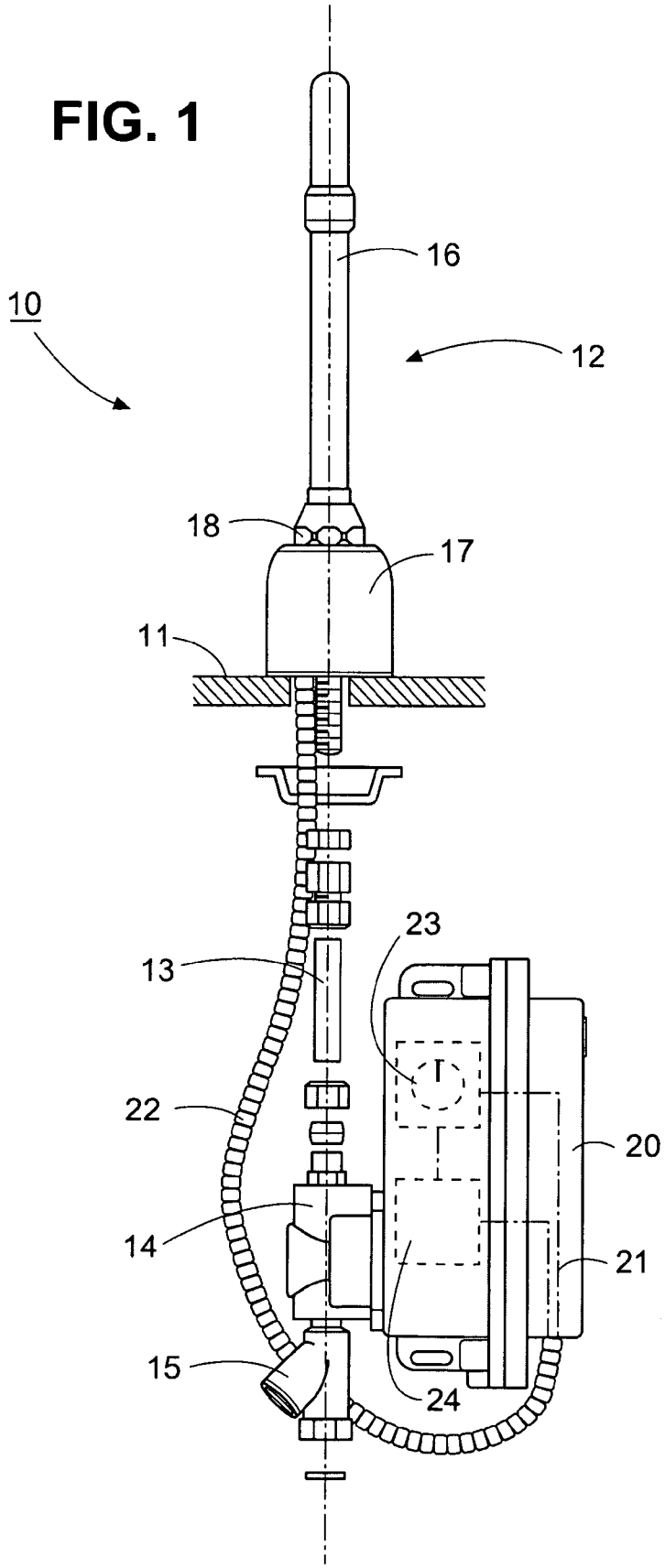
FIG. 1 illustrates a front view of a faucet assembly in accordance with the invention as installed in a sink.

Referring to FIG. 1, the faucet assembly 10 is of generally conventional structure to be mounted on a sink 11 or any other suitable structure. In this respect, the faucet assembly 10 includes a spigot 12 for dispensing water through a predetermined path, for example, a downwardly directed path, a supply pipe 13 for delivering water to the spigot and a solenoid valve 14 in the supply pipe 13 for movement between a closed position in the pipe to block a flow of water through the pipe 13 to the spigot 12 and an open position to allow passage of a flow of water to the spigot 12.

As illustrated, an in-line filter 15 is connected on the upstream side of the solenoid valve 14 to filter water flowing through the valve 14 into the supply pipe 13 from a water main (or the like).

The water supply (not shown) to the supply pipe 13 may include conventional hot and cold water pipes that communicate via a temperature adjuster with the filter 15.

The spigot 12 includes a goose-neck pipe 16 that receives water from the supply pipe 13 and a housing 17 that envelopes the base of the goose-neck pipe 16 and rests on the sink 11. The goose-neck pipe 16 has a threaded lower end for threaded connection to the supply pipe 13 via suitable gaskets and locking nuts.

As indicated in FIG. 1, a locking nut 18 secures the goose-neck pipe 16 to the housing 17 in a firm manner.

Figure 3:
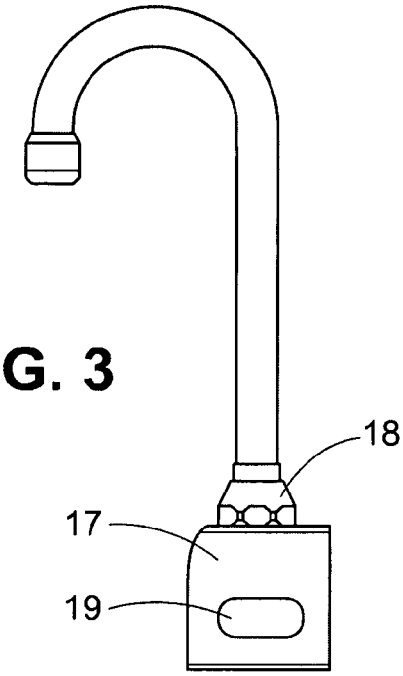
FIG. 3 illustrates a side view of the spigot of the faucet assembly of FIG. 1.

Referring to FIG. 3, wherein like reference characters indicate like parts as above, in accordance with the invention, a sensor 19 is mounted on the side of the housing 17 that is out of the path of water flow from the goose-neck pipe 16. This sensor 19 is of a conventional type for sensing movement of an object thereby, for example in a range of from 13 to 17 centimeters and for emitting a control signal in response to the sensed movement.

The sensor 19 may also be mounted at a remote location spaced from the spigot 12, for example, the sensor 19 may be mounted on the sink 11 at a location convenient to the user, particularly a user not able to activate a sensor on the side of the spigot 12, for example, a person in a wheelchair or a person unable to reach a sensor on the spigot 12 but capable of reaching the water stream from the spigot 12. In such cases, the sensor 19' may be mounted on a part of the sink 11 that is accessible to the user, such as a forward part or the underside of the sink 11.

In further accord with the invention, a control box 20 is mounted on the supply pipe 13 and, particularly, on the solenoid valve 14 in order to emit signals to the solenoid valve 14 to open and close the valve 14.

An electrical circuit 21 is provided in the control box 20 for receiving a control signal from the sensor 19 and for actuating the control box 20 to emit a signal to the solenoid valve 14. In this respect, an electrical line 22 is connected between the sensor 19 and the electrical circuit 21 in order to deliver the control signal or signals thereto.

In the case of a sensor 21 being of the radio frequency (RF) type, there is no need to hard wire the sensor to the control box 20.

When a user moves a hand or other item in the sensing path of the sensor 19, the sensor 19 reacts by sending a control signal to the electrical circuit 21 in the control box 20. The electrical circuit 21 is constructed to receive the control signal and to actuate the control box to emit a signal to the solenoid valve 14 to open the valve thereby allowing water to flow through the supply pipe 13 into the spigot 12 and, thus, into the sink 11. Should the user wave a hand across the sensor 19 a second time, a second control signal is emitted by the sensor 19 via a line 22 to the electrical circuit 21. The circuit 21, in turn, causes the control box 20 to emit a second signal to the solenoid valve 14 in response so as to close the solenoid valve 14 and, thus, shut off the flow of water through the supply pipe 13 into the spigot 12.

The control box 20 is programmed to provide an automatic shut off after a predetermined time period has expired after the first control signal has been received. The automatic shut off function may operate at adjustable times of for example 15, 30, 60 and 90 seconds. This characteristic is provided to prevent an overflow of water from the sink 11 in case the user neglects to pass his/her hand across the sensor 19 to shut off the solenoid valve 14.

To this end, the electrical circuit 21 is provided with a timing switch 23 that is programmed to actuate the control box 20 to emit a second signal to the solenoid valve 14 in response to the expiration of a predetermined time period without a second control signal being received from the sensor 19. The timing switch 23 is adjustable so that the time period can be adjusted and may be constructed in any suitable fashion. For example, the timing switch 23 may be constructed of four dip switches so that different combinations of "up" switches and "down" switches cad provide different time periods or the timing switch may be a continuous timer that can be set.

By way of example, should the automatic shut off function be programmed for a 15 second time delay between control signals from the solenoid 19 and the user requires a longer time period for the flow of water, the timed delay of the timing switch 23 may be manually adjusted. Alternatively, should the flow of water automatic cease, the user need only waive his/her hand across the sensor 19 to initiate re-opening of the solenoid valve 14.

In cases where a desired flow of water is required for a predetermined amount of time, such as 19 seconds, for the proper cleaning of a user's hands in a hospital environment, the timing switch 23 can be set to shut off the faucet assembly 10 after 19 seconds from the start. The user would not then need to be concerned with timing the washing of the user's hands.

By providing the sensor 19 on the side of the faucet assembly and out of the path of the water flow, a user is able to obtain small amounts of water from the spigot 12, for example, for wetting a comb to comb one's hair or to wet a small section of a paper towel and the like.

The faucet assembly 10 of FIG. 1 is constructed to be battery operated. To this end, the control box 20 is provided with a battery 24 that is connected to the electric circuit 21 for delivery of electric power thereto.

Figure 2:
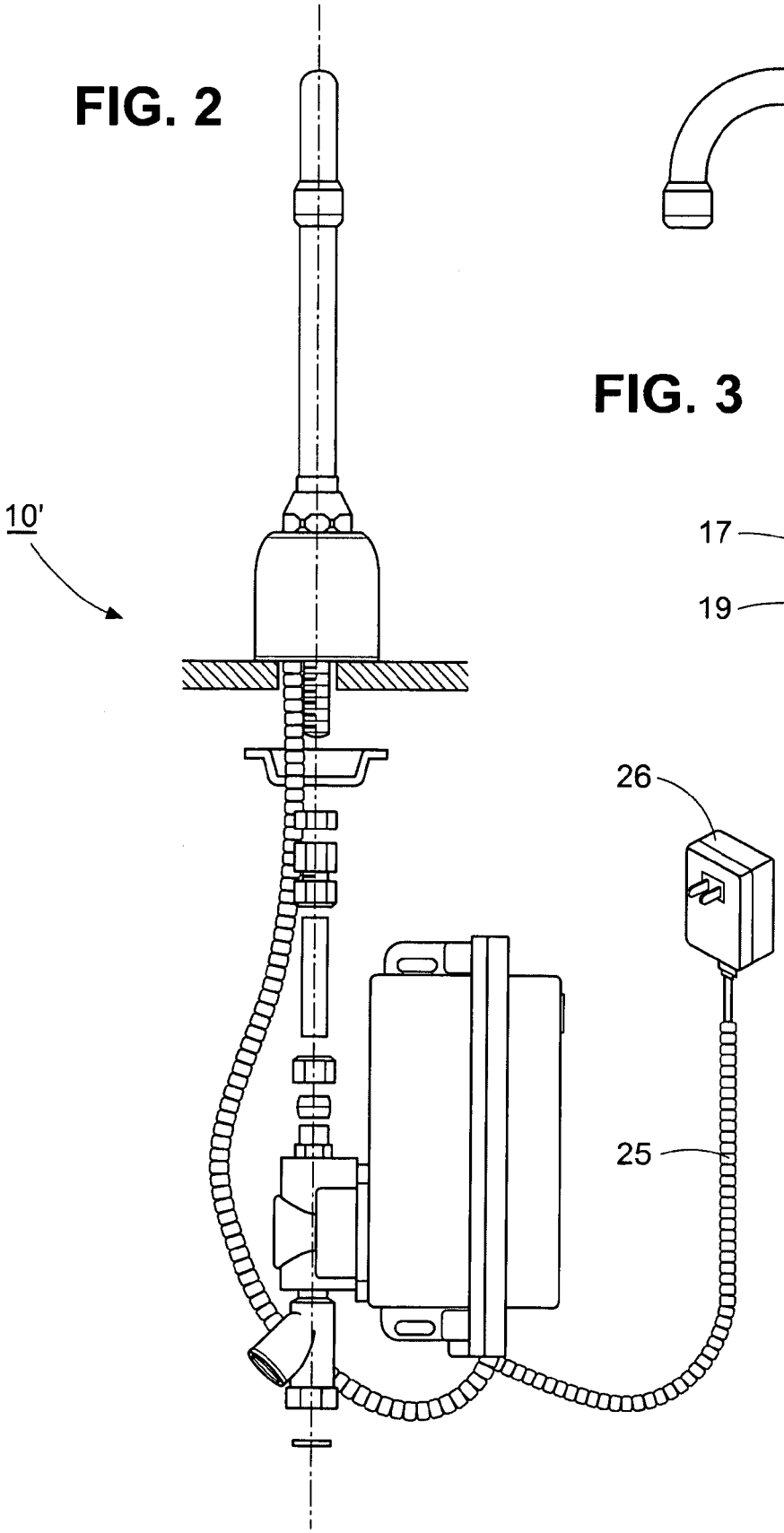
FIG. 2 illustrates a front view of a battery operated faucet assembly in accordance with the invention as installed in a sink.

Referring to FIG. 2, wherein like reference characters indicate like parts as above, the faucet 10' is constructed to be plugged into an outside source of power. To this end, an electrical power line 25 extends from the control box 20 and has a conventional plug 26 at one end for plugging into an electrical wall socket or the like.

The structure of the faucet assembly 10 is such that a person working in an area remote from the spigot 12 but within sight of the spigot 12 and wherein the sensor 19 is positioned can wave a hand across the sensor 19 to activate the faucet assembly 10 so as to replenish water to the area under the spigot 12. That person could also remotely trigger the water flow at the spigot 19 even if not in sight of the spigot 12. For example, a chef working in another location, could replenish water in a boiling pot every so often as deemed necessary, by triggering a fixed amount of water flow into the boiling pot without having to travel to that location, thus, saving time and increasing efficiency. As another example, a gardener or a person growing crops could trigger/stop the flow to water plants or crops without having to turn on/off a valve. Thus sending the exact amount of water to the plants or crops making sure that the exact amount of water is dispensed and conserving water or insuring exact amount and no overage. Both examples could be hard wired or RF.

The invention thus provides a faucet assembly that can be efficiently operated in a hands-free manner without the need for a user to wet his/her hands to operate the assembly. In this respect, the invention provides a hands-free faucet assembly that does not require the presence of a user's hands in the water flow path from the spigot of the assembly for operation.

The invention also provides that the faucet assembly can be shut off by the user by a simple wave of the hand when the user no longer needs any water thereby saving on the amount of water used.

The invention thus provides a faucet assembly that can be operated in an automatic hands-free manner to dispense a flow of water for a preset time.

What is claimed is:

1. A faucet assembly comprising a spigot for dispensing a flow of water through a predetermined path;

a supply pipe for delivering water to said spigot;

a solenoid valve in said pipe for movement between a closed position in said pipe to block the delivery of water through said pipe to said spigot and an open position to allow the delivery of water through said pipe to said spigot;

a control box for selectively emitting a first signal to said valve to move said valve to said open position and for selectively emitting a second signal to said valve to move said valve to said closed position;

a movable sensor of RF type mounted at a remote location from said spigot and spaced from said predetermined path for sensing movement of an object thereby and for emitting a control signal to said control box in response to a sensed movement thereby; and an electrical circuit in said control box for receiving said control signal from said sensor and actuating said control box to emit said first signal to said valve in response to reception of said control signal from said sensor and to emit said second signal to said valve in response to a subsequent reception of said control signal from said sensor within a predetermined time period.

2. A faucet assembly as set forth in claim 1 wherein said control box is mounted on said supply pipe.

3. A faucet assembly as set forth in claim 1 further comprising an electrical power line extending from said control box and electrically connected to said electric circuit for delivery of electric power thereto.

4. A faucet assembly as set forth in claim 1 further comprising a battery within said control box and electrically connected to said electric circuit for delivery of electric power thereto.

5. A faucet assembly as set forth in claim 1 wherein said electric circuit includes an adjustable timing switch for adjusting said predetermined time period.

6. A faucet assembly as set forth in claim 5 wherein said timing switch actuates said control box to emit said second signal to said valve in response to expiration of said predetermined time period without a second control signal being received from said sensor.

7. A faucet assembly as set forth in claim 1 wherein said sensor emits said control signal to said control box in response to a sensed movement thereby within a range of from 13 to 17 centimeters.

8. A faucet assembly comprising a spigot for dispensing a flow of water in a predetermined path;

a supply pipe for delivering water to said spigot;

a solenoid valve in said pipe for movement between a closed position in said pipe to block a flow of water through said pipe to said spigot and an open position to allow passage of a flow of water to said spigot;

a control box mounted on said pipe for selectively emitting a first signal to said valve to move said valve to said open position and for selectively emitting a second signal to said valve to move said valve to said closed position;

a movable sensor of RF type mounted at a remote location from said spigot and in spaced relation to said predetermined path for sensing movement of an object thereby within a predetermined range and for emitting a control signal to said control box in response to a sensed movement thereby; and an electrical circuit in said control box for receiving said control signal from said sensor and actuating said control box to emit said first signal to said valve in response to reception of said control signal from said sensor and to emit said second signal to said valve in response to a subsequent reception of said control signal from said sensor within a predetermined time period, said electric circuit including an adjustable timing switch for adjusting said predetermined time period.

9. A faucet assembly as set forth in claim 8 wherein said timing switch actuates said control box to emit said second signal to said valve in response to expiration of said predetermined time period without a subsequent reception of said control signal being received from said sensor.

10. A faucet assembly as set forth in claim 8 wherein said sensor emits said control signal to said control box in response to a sensed movement thereby within a range of from 13 to 17 centimeters.

11. A faucet assembly comprising a supply pipe for delivering water;

a spigot having a housing and a pipe mounted on said housing and connected to said supply pipe for dispensing the water from said supply pipe through a downwardly directed predetermined path;

a solenoid valve in said pipe for movement between a closed position in said pipe to block the delivery of water through said pipe to said spigot and an open position to allow the delivery of water through said pipe to said spigot;

a control box mounted on said supply pipe for selectively emitting a first signal to said valve to move said valve to said open position and for selectively emitting a second signal to said valve to move said valve to said closed position;

a movable sensor of RF type mounted at a remote location from said spigot and spaced from said predetermined path for sensing movement of an object thereby and out of said predetermined downwardly directed path and for emitting a control signal to said control box in response to a sensed movement of an object thereby; and an electrical circuit in said control box for receiving said control signal from said sensor and actuating said control box to emit said first signal to said valve in response to reception of said control signal from said sensor and to emit said second signal to said valve in response to a subsequent reception of said control signal from said sensor.

12. A faucet assembly as set forth in claim 11 wherein said sensor emits said control signal to said control box in response to a sensed movement thereby within a range of from 13 to 17 centimeters.

* * * * *